US005525868A

United States Patent [19]

Browning

[11] Patent Number: 5,525,868

[45] Date of Patent: Jun. 11, 1996

[54] DISPLAY WITH SWITCHED DRIVE CURRENT

[75] Inventor: Jim J. Browning, Boise, Id.

[73] Assignee: Micron Display, Boise, Id.

[21] Appl. No.: 371,949

[22] Filed: Jan. 12, 1995

Related U.S. Application Data

[63] Continuation of Ser. No. 77,791, Jun. 15, 1993, Pat. No. 5,387,844.

[51] Int. Cl.[6] ..... G09G 3/10

[52] U.S. Cl. ..... 315/169.3; 315/169.1; 315/169.4; 315/349

[58] Field of Search ..... 315/169.3, 169.1, 315/169.4, 311, 349, 58, 334, 339, DIG. 7; 313/309, 336, 351

[56] References Cited

U.S. PATENT DOCUMENTS

| | | | |
|---|---|---|---|
| 3,723,852 | 3/1973 | Peterson et al. | 323/8 |
| 4,554,539 | 11/1985 | Graves | 340/805 |
| 4,866,349 | 9/1989 | Weber et al. | 315/169.4 |
| 5,157,309 | 10/1992 | Parker et al. | 315/169.1 |
| 5,162,704 | 11/1992 | Kobori et al. | 315/349 |
| 5,210,472 | 5/1993 | Casper | 315/349 |
| 5,283,500 | 2/1994 | Kochanski | 315/58 |
| 5,300,862 | 4/1994 | Parker et al. | 315/169.1 |
| 5,313,140 | 5/1994 | Smith et al. | 315/169.1 |
| 5,357,172 | 10/1994 | Lee et al. | 315/167 |

FOREIGN PATENT DOCUMENTS

| | | | |
|---|---|---|---|
| 9205571 | 4/1992 | European Pat. Off. | 315/169.1 |

*Primary Examiner*—Robert J. Pascal
*Assistant Examiner*—Haissa Philogene

[57] ABSTRACT

A Field Emission Display ("FED") is disclosed having a brightness to project images. To achieve this benefit, the FED includes a pixelator is coupled to a display for displaying and projecting the image. By design, the pixelator conducts a drive current passing through the display grid corresponding to a degree of brightness in the resulting panel display. A first resistor having a first value is coupled between the pixelator and a voltage node or ground. Moreover, a second resistor having a second value at most one half of the first value is employed. A switch for connecting the first resistor in parallel with the second resistor is closed when a control signal is received. When the switch is enabled, the equivalent resistance between the pixelator and a voltage node or ground is substantially reduced. In another embodiment, a tapped resistor replaces the first resistor and the second resistor. When the control signal is received, a portion of the drive current is shunted through the switch.

31 Claims, 5 Drawing Sheets

DISPLAY WITH SWITCHED DRIVE CURRENT

This application is a continuation of application Ser. No. 08/077,791, filed Jun. 15, 1993, now U.S. Pat. No. 5,387, 844.

FIELD OF THE INVENTION

The present invention relates to flat panel displays and, more particularly, to an apparatus for switching the brightness of a flat panel display.

BACKGROUND OF THE INVENTION

Until recently, the cathode ray tube ("CRT") has been the primary device for displaying information. While having sufficient display characteristics with respect to color, brightness, contrast and resolution, CRTs are relatively bulky and power hungry. In view of the advent of portable laptop computers, the demand has intensified for a display technology which is lightweight, compact, and power efficient.

One available technology is flat panel displays, and more particularly, Liquid Crystal Display ("LCD") devices. LCDs are currently used for laptop computers. However, those LCD devices provide poor contrast in comparison to CRT technology. Further, LCDs offer only a limited angular display range. Moreover, color LCD devices consume power at rates incompatible with extended battery operation. In addition, a color LCD type screen tends to be far more costly than an equivalent CRT.

In light of these shortcomings, there have been several developments recently in thin film, Field Emission Display (FED) technology. In U.S. Pat. No. 5,210,472, commonly assigned with the present invention, an FED design is disclosed which utilizes a matrix-addressable array of pointed, thin-film, cold emission cathodes in combination with a phosphor luminescent screen. There, the FED incorporates a column signal to activate a single conductive strip within the cathode grid, while a row signal activates a conductive strip within the emitter base electrode. At the intersection of both an activated column and an activated row, a grid-to-emitter voltage differential exists sufficient to induce a field emission, thereby causing illumination of the associated phosphor of a pixel on the phosphorescent screen. Extensive research has recently made the manufacture of an inexpensive, low power, high resolution, high contrast, full color FED a more feasible alternative to LCDs.

In light of its inexpensive, low power, full color, high resolution, high contrast capabilities, several new applications of FED technology are currently being explored. One area of interest is utilizing FEDs in the projection of images. For example, in the area of video camera technology, where a viewfinder displays the captured image within a channel designed for close viewing, there has been a growing interest in projecting the captured image onto a background. Presently, FEDs display images by illuminating a pixel on the phosphorescent screen. Nonetheless, the energy generated by the FED in the process of illumination is insufficient to project an image from the display onto a background.

SUMMARY OF THE INVENTION

The primary advantage of the present invention is to eliminate the aforementioned drawbacks of the prior art.

A further advantage of the present invention is to provide an apparatus for switching the brightness of a flat panel display.

Another advantage of the present invention is to provide an FED that can display and project images.

In order to achieve these hereinabove advantages, as well as others which will become apparent hereafter, a field emission display ("FED") of the present invention has a variable brightness to project images. To achieve this benefit, the FED includes a pixelator coupled to a display for displaying and projecting the image. By design, the pixelator conducts a drive current passing through the display grid corresponding to a degree of brightness in the resulting panel display. In a first embodiment of the present invention, a voltage controlled resistor is coupled between the pixelator and a voltage node or ground. In a second embodiment, a first resistor having a first value, is coupled between the pixelator and a voltage node or ground. Moreover, a second resistor having a second value at most one half of the first value is employed. A switch for connecting the first resistor in parallel with the second resistor is closed when a control signal is received, the switch is enabled, the equivalent resistance between the pixelator and a voltage node or ground is substantially reduced. In a further embodiment of the invention, the first resistor comprises a resistive layer, while the second resistor comprises a tap for tapping the resistive layer between the first and second terminations of the resistive layer, thereby creating the second resistor smaller than the first resistor.

Other aspects and advantages will become apparent to those skilled in the art from the following detailed description read in conjunction with the appended claims and the drawings attached hereto.

BRIEF DESCRIPTION OF THE DRAWINGS

The present invention will be better understood from reading the following description of non-limitative embodiments, with reference to the attached drawings, wherein below.

It should be emphasized that the drawings of the instant application are not to scale but are merely schematic representations and are not intended to portray the specific parameters or the structural details of the invention, which can be determined by one of skill in the art by examination of the information herein.

DETAILED DESCRIPTION OF THE INVENTION

Figure 1:
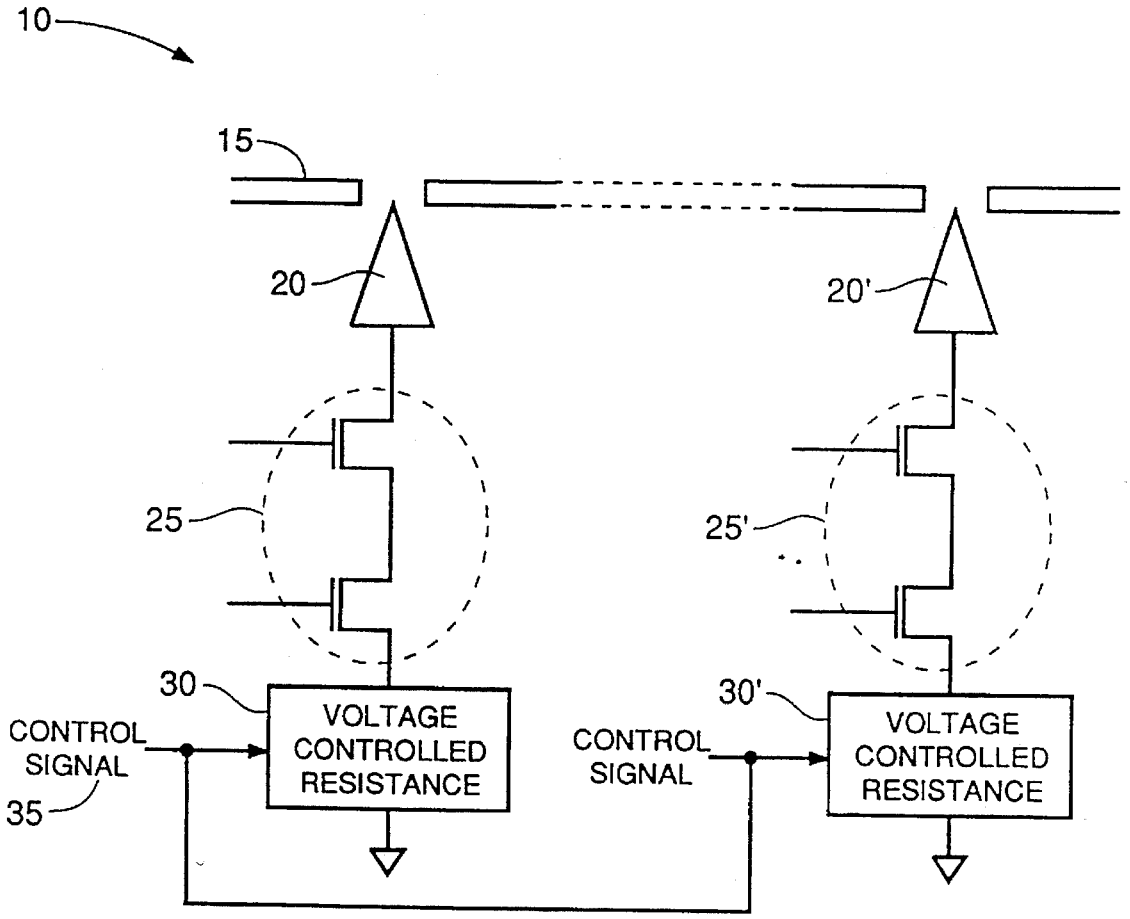
FIG. 1 is a schematic diagram of a field emission display device employing a first embodiment of the present invention.

Referring to FIG. 1, a Field Emission Display ("FED") device 10 is illustrated employing a first embodiment of the present invention. Device 10 comprises a series of field emitter tips 20 and 20 and a display grid 15. Relying on the principles of FED technology, as described in U.S. Pat. No. 5,210,472 and incorporated herein by reference, electrons are emitted via tips 20 and 20 and through grid 15 in order to illuminate a phosphorus background (not shown) and display an image.

Incorporated with the field emitter tips 20 and 20' and display grid 15 are pixelators 25 and 25'. Pixelators 25 and 25' each have a first termination coupled to a tip 20 or 20' and are enabled by means of a row control and a column control signal. Once enabled, pixelators 25 and 25' drive field emitter tips 20 and 20' by means of a drive current, acting as a constant current source for device 10. Further, a dependent relationship exists between the drive current associated with each pixelator and the brightness associated with that emitter tip.

In order for proper operation, each pixelator, 25 and 25', comprises a resistance coupled between its second termination and ground through which its drive current is conducted. This resistance can be either a discrete resistor or a layer of material having a predetermined resistivity. As each pixelator, 25 and 25', acts as a constant current source, given a resistance having a predetermined value, the drive current supplied to its coupled emitter tip will be a known, quantifiable value.

Under the arrangement described hereinabove, the drive current is limited by the value of the gate resistance interposed between the gate terminals of the pixelator and ground. However, in the event device 10 was required to project an image, a greater brightness and luminescence would be required. Given the relationship between drive current and brightness, a means for varying the drive current is needed in order to project an image on a background.

In order to address this particular need, several realizations are available. In FIG. 1, a voltage controlled resistance 30 and 30' is utilized between the second termination of each pixelator, 25 and 25', and a voltage node or ground. Enabled by a control signal 35, this design provides a controlled means for varying the drive current resistance. Thus, voltage controlled resistance 30 and 30' can provide several degrees of brightness, the greatest being when device 10 is chosen for projection purposes. In this scenario, the control signal enables an extremely low resistance value from voltage controlled resistance 30 and 30', thereby providing the maximum available drive current through each pixelator, 25 and 25', while maintaining the integrity and functionality of device 10.

Figure 2A:
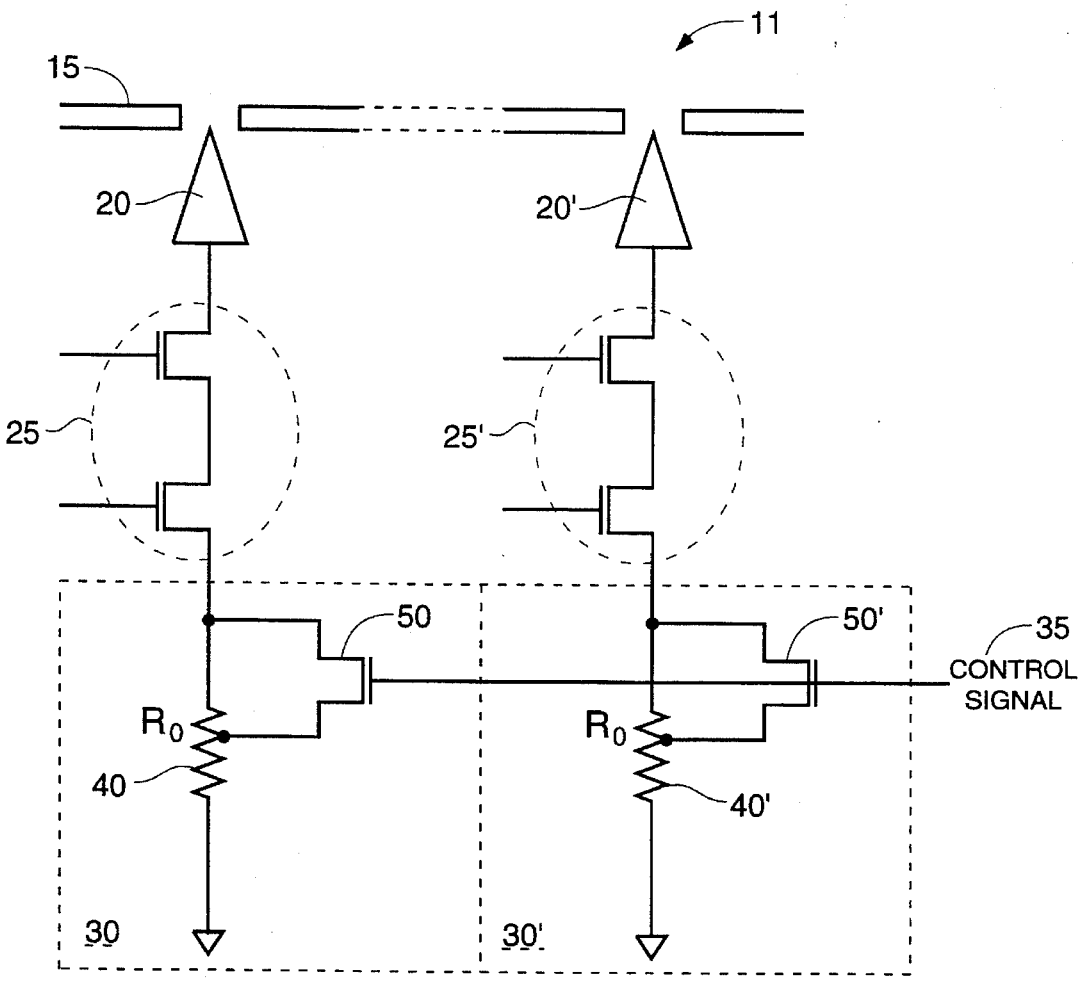
FIG. 2(*a*) is a schematic diagram of a field emission display device employing a second embodiment of the present invention, FIG. 2(*b*) is a diagrammatic view of a physical realization of the second embodiment, while FIG. 2(*c*) is a alternate realization of the second embodiment.
Figure 2B:
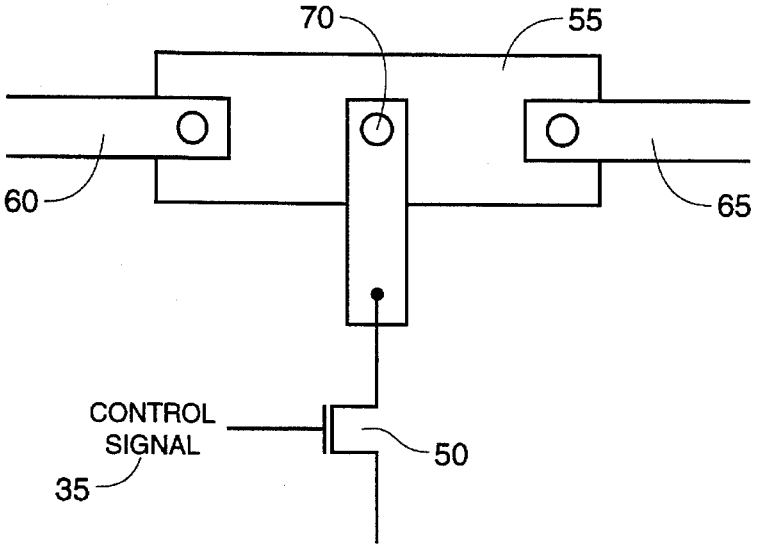
Figure 2C:
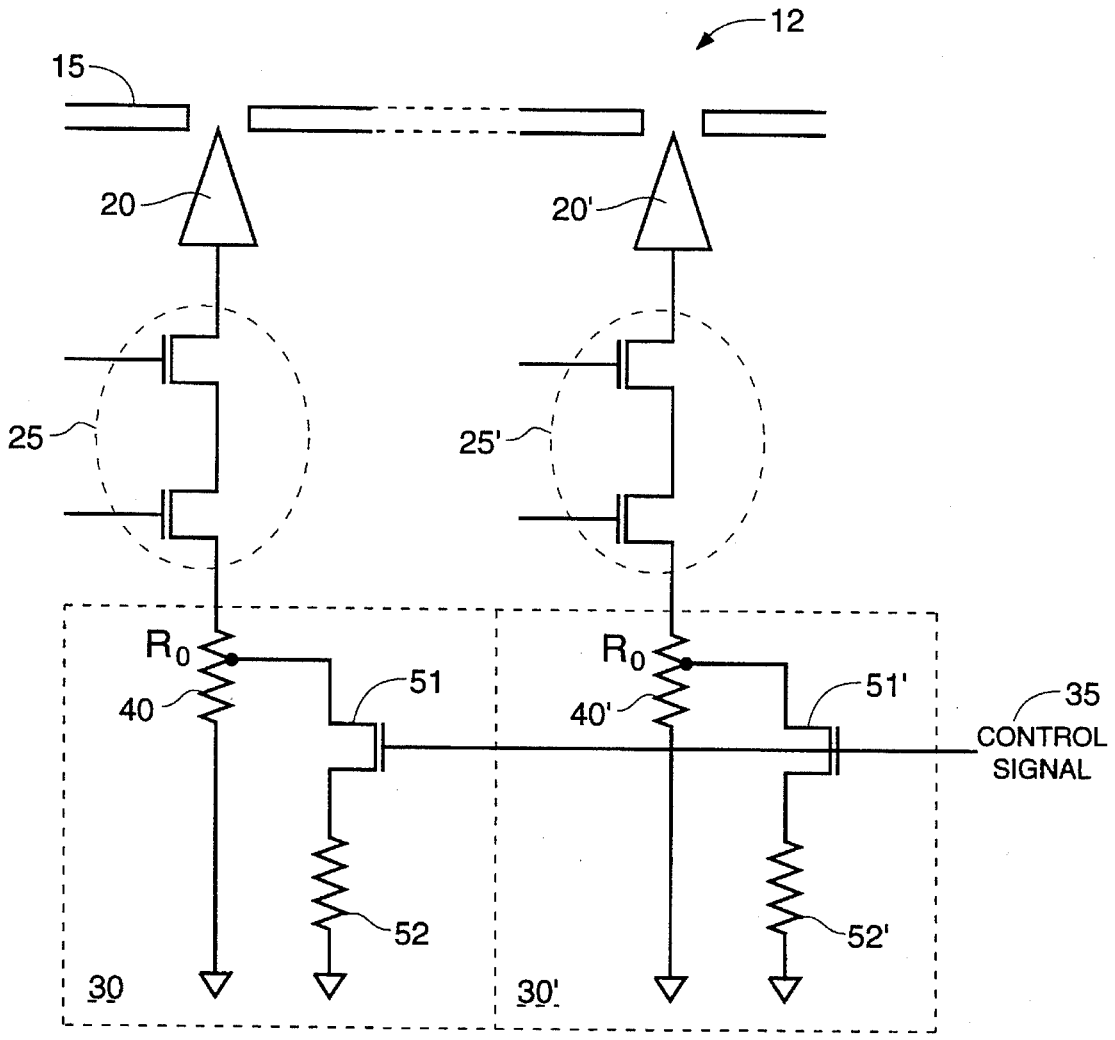

Referring to FIGS. 2(*a*), (*b*), and (*c*), a second embodiment of the present invention is provided. For realizing the means for varying the drive current in order to project an image on a background by way of a voltage controlled resistance, a tapped resistance is employed.

With respect to FIG. 2 (a), a preferred field emission display device 11 design is shown of a drive current resistance 40 with a layer of material having a predetermined resistivity interposed between the second termination of each pixelator, 25 and 25', and a voltage node or ground. To lower the effective resistance between each pixelator and a voltage node or ground, each resistance 40 and 40', tapped is of some point by one conductor of a switch 50 and 50'. Once enabled by a control signal 35, a second conductor of each switch, 50 and 50', conductively taps each pixelators associated resistance, 40 and 40'. However, it should obvious to one of ordinary skill in the art that the second conductor of each switch, 50 and 50', could conductively tap the base voltage node or ground. Each switch 50 and 50', preferably comprising a field effect transistor, acts as a shunt by tapping resistance 40 to reduce the effective resistance viewed by each pixelator.

Referring in FIG. 2(*b*), resistance 40 is shown in greater detail. Resistance 40 comprises a layer 55 having a first and second termination, 60 and 65, whereby first termination 60 is coupled with pixelator 25 and second termination 65 is coupled with a voltage node or ground. Between the first and second terminations, 60 and 65, a conductive tap 70 is used. Tap 70 is employed for tapping the resistive layer 55. By this arrangement, the effective resistance viewed by pixelator 25 is reduced according to the position of tap 70 along layer 55. This positioning is dependent on design considerations associated with the resistance, as well as the operating current necessary to drive switches 50 and 50'. As such, the resistance created between the tapping point and second termination is preferably greater than the resistance between the tapping point and the first termination. As described above, conductive tap 70 is enabled by switch 50 through control signal 35.

In FIG. 2(*c*), drive current resistance 40 and 40' is shown each comprising a layer of material having a predetermined resistivity. Resistance 40 and 40' is interposed between the second termination of each pixelator, 25 and 25', and a voltage node or ground, as described above. To lower the effective resistance between each pixelator and a voltage node or ground, each resistance, 40 and 40', is tapped at some point by one conductor of a switch, 51 and 51'. Once enabled by a control signal 35, a second conductor of each switch, 51 and 51', is conductively coupled with a resistor, 52 and 52'. Each resistor, 52 and 52', is coupled to a base voltage node or ground commonly shared with the second termination of resistances, 40 and 40'. However, it should be obvious to one of ordinary skill in the art that the second conductor of each switch, 51 and 51', could be conductively coupled to the node where each pixelator is coupled with its associated resistance, 40 and 40'.

It should be noted that design considerations factor into the actual values associated with resistors, 52 and 52'. Each switch 51 and 51', preferably comprising a field effect transistor, acts as a shunt by tapping resistance 40 to reduce the effective resistance viewed by each pixelator. Should switches 51 and 51' be realized by field effect transistors, the values considered for resistors, 52 and 52 , must maintain the stability of the overall device 12, the pixelators 25 and 25', as well as the region for which the transistor operates as a switch.

Figure 3:
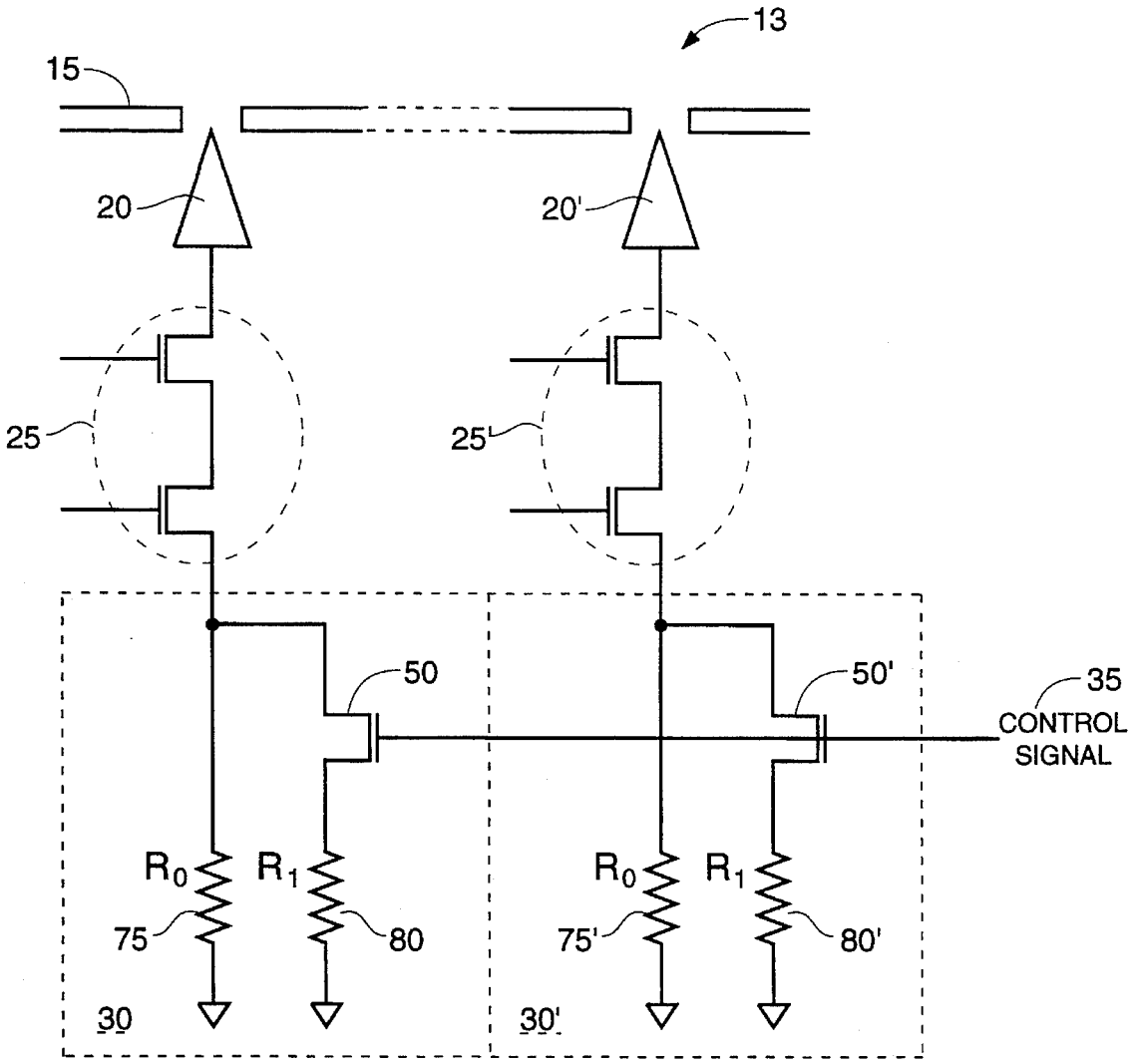
FIG. 3 is a schematic diagram of a field emission display device employing a third embodiment of the present invention.

Referring to FIG. 3, a third embodiment of the present invention is shown. In place of tap 70, this embodiment employs a discrete drive current resistor 75 between each pixelator, 25 and 25', and ground. Further, a second resistor 80 is provided in parallel with drive current resistor 75. However, second resistor 80 conducts current only when switch 50, preferably comprising a field effect transistor, is enabled. Switch 50 is enabled by means of control signal 35. It should be obvious to one of ordinary skill in the art that this same structure applies to each pixelator employed in device 13.

Figure 4:
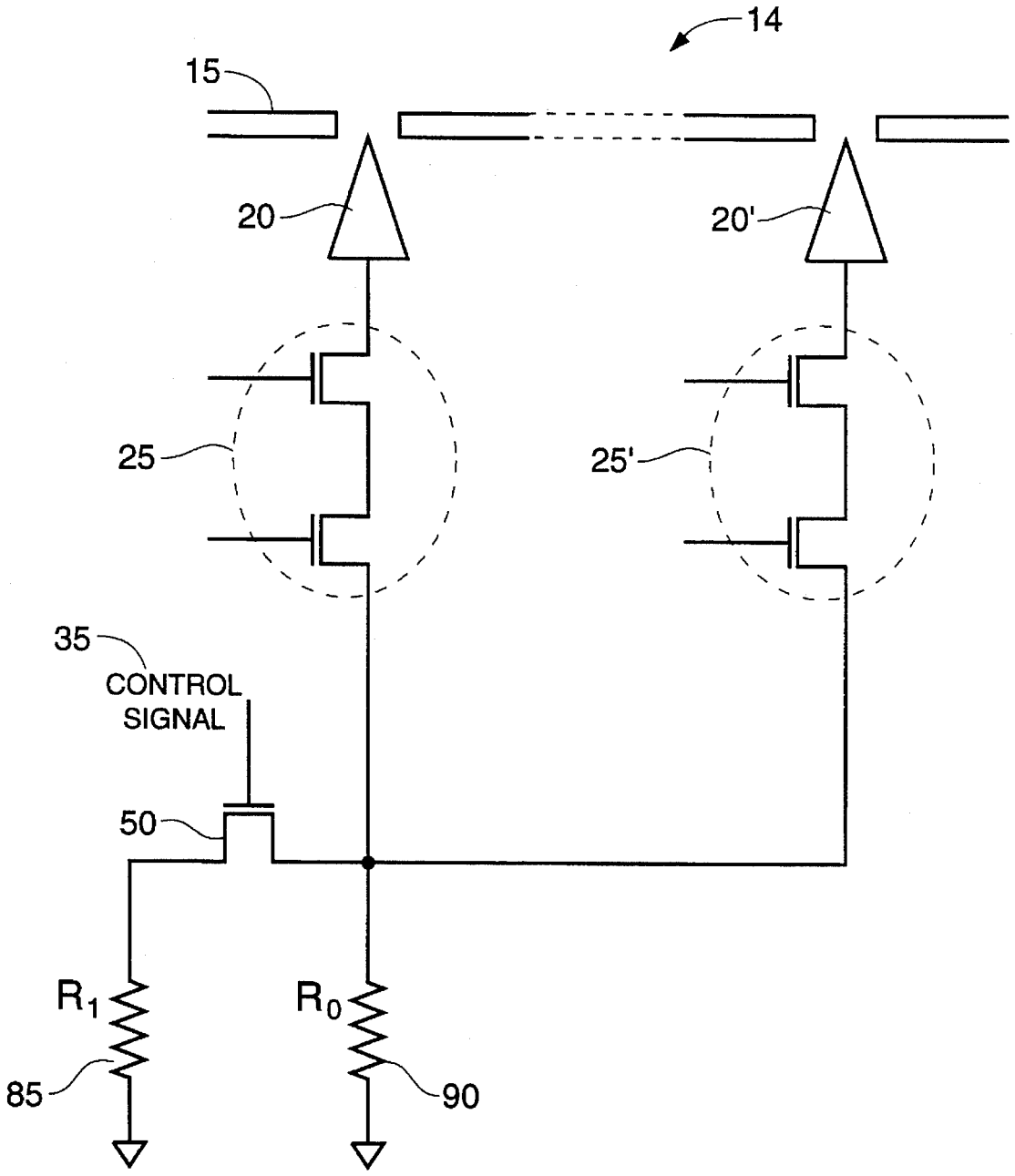
FIG. 4 is a schematic diagram of a field emission display device employing a fourth embodiment of the present invention.

Referring to FIG. 4, a fourth embodiment of the present invention is illustrated. For reducing the overall size of device 14 employing the present invention, one drive current resistor 90 is employed for all pixelators used in device 14. Further, a second resistor 85 is provided in parallel with drive current resistor 90 by means of switch 50, which preferably comprises a field effect transistor. Switch 50 allows current to pass through second resistor 85 upon receiving control signal 35. As before, the effective or equivalent drive current resistance viewed by the pixelators is substantially reduced. It should be noted that this particular embodiment is pertinent where discrete component resistors are used.

By employing any of the embodiments described herein, the drive current resistance is substantially reduced when control signal 35 is enabled. To achieve this end, the second resistance must be at most one half of the value of the drive current resistance to substantially reduce the effective drive current resistance. By this approach, the effective drive current is substantially increased thereby enabling device 10–14 to project images onto a background, such as a wall.

The primary purpose of substantially reducing the drive current resistance is directed to uses where device 10–14 is switched into a projection mode of operation. Other modes for operating device 10–14, however, are conceivable. For example, when device 10–14 is being viewed in an environment not conducive to viewing, a greater brightness may be required than that needed in its normal expected environment.

While the particular invention has been described with reference to illustrative embodiments, this description is not meant to be construed in a limiting sense. It is understood that although the present invention has been described in a preferred embodiment, various modifications of the illustrative embodiments, as well as additional embodiments of the invention, will be apparent to persons skilled in the art upon reference to this description without departing from the spirit of the invention, as recited in the claims appended hereto. For example, the present invention pertains to flat panel display, and more particularly, FEDs. Nonetheless, the inventive features described herein can also be incorporated in LCD technology. It is therefore contemplated that the appended claims will cover any such modifications or embodiments as fall within the true scope of the invention.

All of the U.S. Patents cited herein are hereby incorporated by reference as if set forth in their entirety.

What is claimed is:

1. A display comprising:

a. a resistor that conducts a current, wherein a brightness of the display is responsive to the current, the resistor comprising a tap; and b. a switch, coupled to the tap, for controlling the current in response to a control signal so that the brightness is responsive to the control signal.

2. The display of claim 1 wherein the resistor is coupled to a field emitter tip.

3. The display 1 wherein the resistor is coupled to a liquid crystal display element.

4. The display of claim 1 wherein the switch is characterized by a first conductivity for enabling directly viewing an image on the display.

5. The display of claim 4 wherein the switch is characterized by a second conductivity for enabling projecting the image onto a background for indirectly viewing the image.

6. The display of claim 1 wherein the switch comprises a field effect transistor having a gate coupled to the control signal.

7. The display of claim 6 wherein the transistor shunts a portion of the resistor.

8. The display of claim 6 wherein the current comprises a second current conducted through the tap, the transistor, and a second resistor.

9. A display comprising:

a. a first resistor that conducts a first current, wherein a brightness of the display is responsive to the first current; and b. a second resistor, coupled to the first resistor by a switch, wherein the second resistor conducts a second current and the brightness of the display is further responsive to the second current.

10. The display of claim 9 wherein the first resistor is coupled to a field emitter tip.

11. The display of claim 9 wherein the resistor is coupled to a liquid crystal display element.

12. The display of claim 9 wherein the switch is characterized by a first conductivity for enabling directly viewing an image on the display.

13. The display of claim 12 wherein the switch is characterized by a second conductivity for enabling projecting the image onto a background for indirectly viewing the image.

14. The display of claim 9 wherein the switch comprises a field effect transistor having a gate coupled to a control signal, the brightness being responsive to the control signal.

15. A display comprising a matrix of row-column intersections wherein a circuit is located at each row-column intersection, the circuit comprising:

a. a switch for controlling display brightness;

b. a resistor coupled to the switch, the resistor comprising a tap; and c. a current source responsive to a control signal, the current source coupled to the tap, wherein display brightness is responsive to the control signal.

16. The display of claim 15 wherein the circuit further comprises a second current source comprising the resistor.

17. The display of claim 15 wherein the circuit further comprises a field emitter tip.

18. The display of claim 15 wherein the switch is coupled to a liquid crystal display element.

19. The display of claim 15 wherein the current source comprises a transistor responsive to the control signal.

20. A display comprising a matrix of row-column intersections wherein a circuit is located at each row-column intersection, the circuit comprising:

a. a first switch that selectively enables display by conducting a drive current;

b. a first current source in series with the first switch, wherein the first current source provides a first portion of the drive current; and c. a second current source coupled in parallel with the first current source, wherein the second current source provides a second portion of the drive current when selectively enabled by a brightness control signal.

21. The display of claim 20 wherein the circuit further comprises a field emitter tip.

22. The display of claim 20 wherein the circuit further comprises a liquid crystal display element.

23. The display of claim 20 wherein the first current source comprises a first resistor.

24. The display of claim 23 wherein:

a. the second current source comprises a second resistor coupled in parallel with the first resistor; and b. the second portion of the drive current passes through the second resistor.

25. The display of claim 20 wherein:

a. the first current source comprises a resistor coupled to the second current source, the resistor comprising a tap; and b. the second portion of the drive current is conducted through the tap.

26. The display of claim 20 wherein the second current source comprises a second switch that conducts the second portion of the drive current in response to the control signal.

27. The display of claim 26 wherein the second switch comprises a field effect transistor.

28. The display of claim 20 wherein the first portion of the drive current enables directly viewing an image on the display and the second portion of the drive current enables projecting the image onto a background for indirectly viewing the image.

29. A display comprising:

a. a first pixel having a first brightness, the first pixel enabled for display by a first switch, the first switch for selectively passing a first drive current;

b. a second pixel having a second brightness, the second pixel enabled for display by a second switch, the second switch for selectively passing a second drive current;

c. a first current source coupled to the first switch and coupled to the second switch, the first current source for providing a first portion of both the first drive current and the second drive current; and d. a second current source coupled in parallel with the first current source, the second current source for providing, when selectively enabled by a control signal, a second portion of both the first drive current and the second drive current so that the first brightness and the second brightness are responsive to the control signal.

30. The display of claim 29 wherein:

a. the first switch comprises a first transistor responsive to a row signal and a second transistor responsive to a first column signal; and b. the second switch comprises a third transistor responsive to the row signal and a fourth transistor responsive to a second column signal.

31. The display of claim 30 wherein the first portion of the drive current enables directly viewing an image on the display and the second portion of the drive current enables projecting the image onto a background for indirectly viewing the image.

* * * * *